United States Patent [19]

Robertson

[11] 4,226,453

[45] Oct. 7, 1980

[54] PIVOTING ARM DOOR LOCK MECHANISM

[76] Inventor: Gene V. Robertson, 1906 Esther Dr., Carlisle, Pa. 17013

[21] Appl. No.: 9,767

[22] Filed: Feb. 6, 1979

[51] Int. Cl.[3] ..... E05C 17/16

[52] U.S. Cl. ..... 292/268

[58] Field of Search ..... 292/267, 268, 269, 270, 292/274

[56] References Cited

U.S. PATENT DOCUMENTS

| | | | |
|---|---|---|---|
| 197,577 | 11/1877 | Whipple . | |
| 251,732 | 1/1882 | Phillips | 292/268 |
| 388,074 | 8/1888 | Reardon et al. | 292/269 |
| 416,874 | 12/1889 | Trabold . | |
| 622,556 | 4/1899 | Speirs . | |
| 1,038,752 | 9/1912 | Hofbauer . | |
| 1,722,736 | 7/1929 | Derbyshire . | |
| 2,102,729 | 12/1937 | McDonald . | |
| 3,458,226 | 7/1969 | Carlston . | |
| 4,062,578 | 12/1977 | Chen . | |

FOREIGN PATENT DOCUMENTS

| | | | |
|---|---|---|---|
| 1231590 | 10/1960 | Fed. Rep. of Germany | 292/268 |

*Primary Examiner*—Richard E. Moore

*Attorney, Agent, or Firm*—Fisher, Christen & Sabol

[57] ABSTRACT

A pivoting arm door lock mechanism is disclosed which allows the user to lock the door in a fully closed position or a partially opened position merely by positioning a single arm. The mechanism also permits the user to open the door to an intermediate position without locking it in that position. The mechanism consists of a slidable T-bolt attached to the door which slides along a generally horizontal axis. A slotted arm, being pivotable in a generally vertical plane, is attached to the door jamb such that the head of the T-bolt engages the slot in the pivoting arm. In order for the T-bolt head to pass through the pivoting arm, the arm must be in a vertical orientation. When in this position, the door is locked in a fully closed position since the longitudinal axis of the T-bolt passes through the pivoting axis of the arm. In order to open the door to either a first or second partially opened positions, the arm is rotated to a horizontal position which allows the T-bolt to slide along its slot. The bolt may not be withdrawn when the arm is in its horizontal position since the height of the T-head is wider than the width of the slot. A locking mechanism on the pivoting arm enables the user to lock the door in its second partially opened position.

7 Claims, 4 Drawing Figures

PIVOTING ARM DOOR LOCK MECHANISM

FIELD OF THE INVENTION

This invention relates to door locking mechanisms, more specifically those mechanisms comprising a pivotable arm engaging a slidable dead-bolt.

BRIEF DESCRIPTION OF THE PRIOR ART

House or apartment dwellers have long sought an effective safety door lock mechanism which would enable them to not only lock their doors in a fully closed position, but also permit the door to be opened slightly to enable the occupant to ascertain the identity of a caller before completely unlocking the door. Perhaps the most widely known locking device in this field is the ubiquitous door chain lock. Typically, this locking device comprises a relatively short chain having one end attached to the door jamb and a slider device affixed to its opposite end. The slider engages a corresponding slot located on the door such that when the slider is engaged, the door is permitted to open only a slight amount. Although this device has been widely accepted, it does not satisfy all of the requisite criteria of an effective safety door locking mechanism. The door chains do not lock the door in a completely closed position, nor do they permit the locking of the door in one or more open positions. It is often necessary to open the door to an apartment or house a slight amount and hold it securely in this position so as to increase ventilation, sign receipts for packages and letters, etc. In order to lock the door in a completely closed position, another lock is required in addition to the chain lock mechanism. Even more importantly, the chain lock mechanism may easily be broken or cut by an undesired intruder in order to obtain access to the interior of the dwelling.

The deficiencies of the chain lock mechanism are wellknown and several attempts have been made in the past to provide safety door locking mechanisms which overcome these deficiencies. Typically, these devices have utilized a pivoting arm attached to the door jamb and either a fixed or sliding bolt mechanism attached to the door which engages the pivoting arm. The following U.S. patents illustrate the state-of-the-art of these pivoting arm devices: U.S. Pat. Nos. 197,577; 416,874; 622,556; 1,038,752; 1,722,736; 2,102,729; 3,458,226; and 4,062,578. All of these prior art patents, with the exception of U.S. Pat. No. 1,038,752 and 3,458,226, utilize a slotted arm which pivots in a generally horizontal plane attached to the door jamb. In the two specified patents, the arm is pivotably attached to the door jamb such that it pivots in a generally vertical plane.

In both of the patents which utilize a vertically pivoting arm, a slidable dead-bolt mechanism attached to the door engages the arm and permits the door to be opened only to the end thereof. Both of these devices also have means to lock the door in the fully closed position, either by extending the dead-bolt into the door jamb itself, or by using a separate slidable dead-bolt. Neither of these devices are capable of locking the door in one or more partially opened positions nor does either show a mechanism wherein the longitudinal axis of the slidable dead-bolt is coincident with the pivoting axis of the arm. This latter feature is of some importance since (if the dead-bolt mechanisms locking the door in the closed position are not engaged) an intruder may open the door to the limits of its partially opened position and cut through or otherwise break the pivotable arm. A sharp blow to the door will cause the pivoting arm to pivot to its horizontal position due to its engagement with the slidable bolt since the axis of the bolt is not coincident with the pivoting axis of the arm. If this should happen the intruder may cut through the arm thereby rendering the locking mechanism totally ineffective.

Of the remaining U.S. patents listed above, only two (U.S. Pat. Nos. 622,556 and 2,102,729) have the capability of locking the door in both a fully closed, and partially opened positions. However, both of these devices utilize a slotted arm pivoted so as to move in a generally horizontal plane and are generally complex and difficult to operate.

SUMMARY OF THE INVENTION

The instant invention relates to a door locking mechanism having the capabilities of locking the door in a fully closed, or partially opened position while at the same time being simple in construction and easy to use. The mechanism according to the invention comprises a slotted arm having one end pivotably attached to the door jamb such that the arm pivots in a generally vertical plane. A slidable dead-bolt having a "T" shaped head is attached to the door adjacent to the slotted arm. When the slotted arm is in its vertical orientation, the width of the slot is somewhat larger than the width of the "T" shaped head of the dead-bolt such that it may slide through the slot. Since the longitudinal axis of the dead-bolt coincides with the pivoting axis of the arm when the arm is in its vertical orientation engaging the dead-bolt, the door is locked in a fully closed position. Since the axes are coincident, any force exerted on the door to open it will not tend to pivot the arm about its pivoting axis. This renders the door completely and effectively locked in its closed position.

When it is desired to partially open the door to ascertain the identity of a caller, the arm is placed in a horizontal orientation by the occupant and, since the dead-bolt will slide along the slot, the door may be partially opened. The vertical dimension of the "T" shaped bolt head is greater than the width of the slot to prevent the bolt from pulling out of the arm when in its horizontal position. The length of the dead-bolt is such that it will slide in its retaining sleeve to accommodate the arc of the door opening although the slotted arm may be straight. An actuating handle, extending inwardly from the dead-bolt prevents the dead-bolt from pulling out of its retaining sleeve. The distal end of the arm has attached thereto a pivoting stop mechanism. When the stop is in its lower position it extends across the width of the slot such that when the door is opened the dead-bolt bears against one end of the stop to allow the door to be opened to a first partially opened position. If it is desired to further partially open the door to accept a letter, package or the like, or to lock the door in a partially opened position to facilitate ventilation, the stop is raised to allow the bolt to slide to the end of the slot in the pivoting arm. The stop is then pivoted back to its initial position so as to grip the dead-bolt between the stop and the end of the slot in the pivoting arm. This effectively locks the door in a second partially opened position.

DETAILED DESCRIPTION OF THE PREFERRED EMBODIMENT

Figure 1:
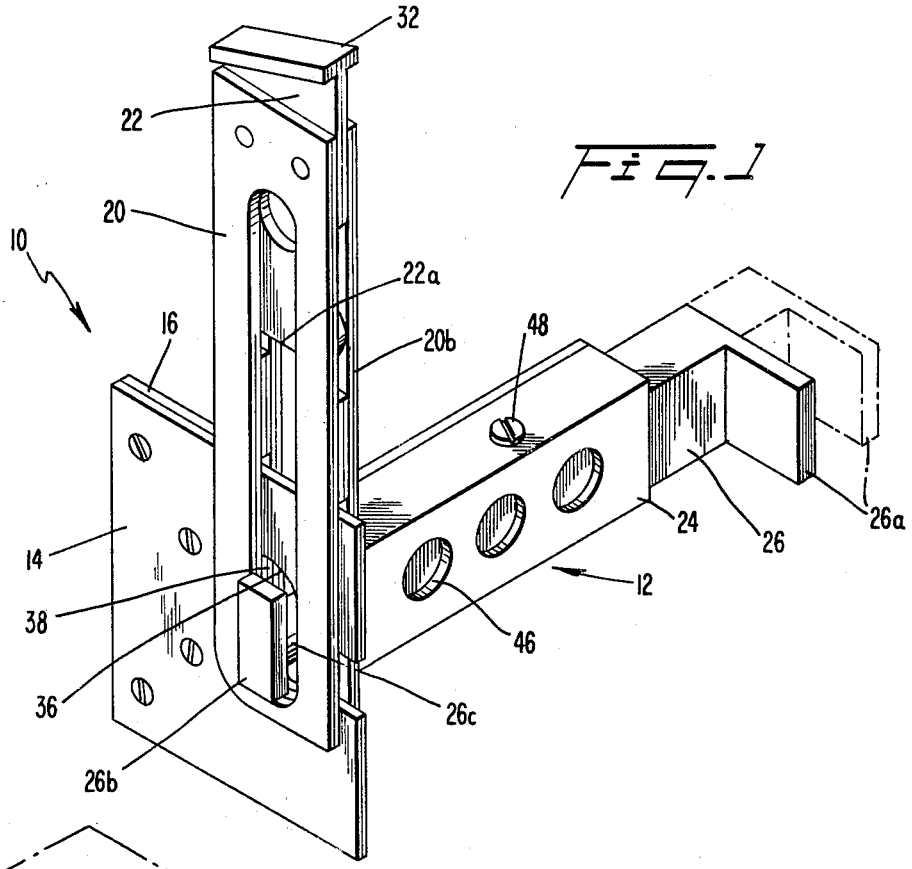
FIG. 1 is a perspective view showing the pivoting door safety lock mechanism according to the invention in its fully locked position.
Figure 2:
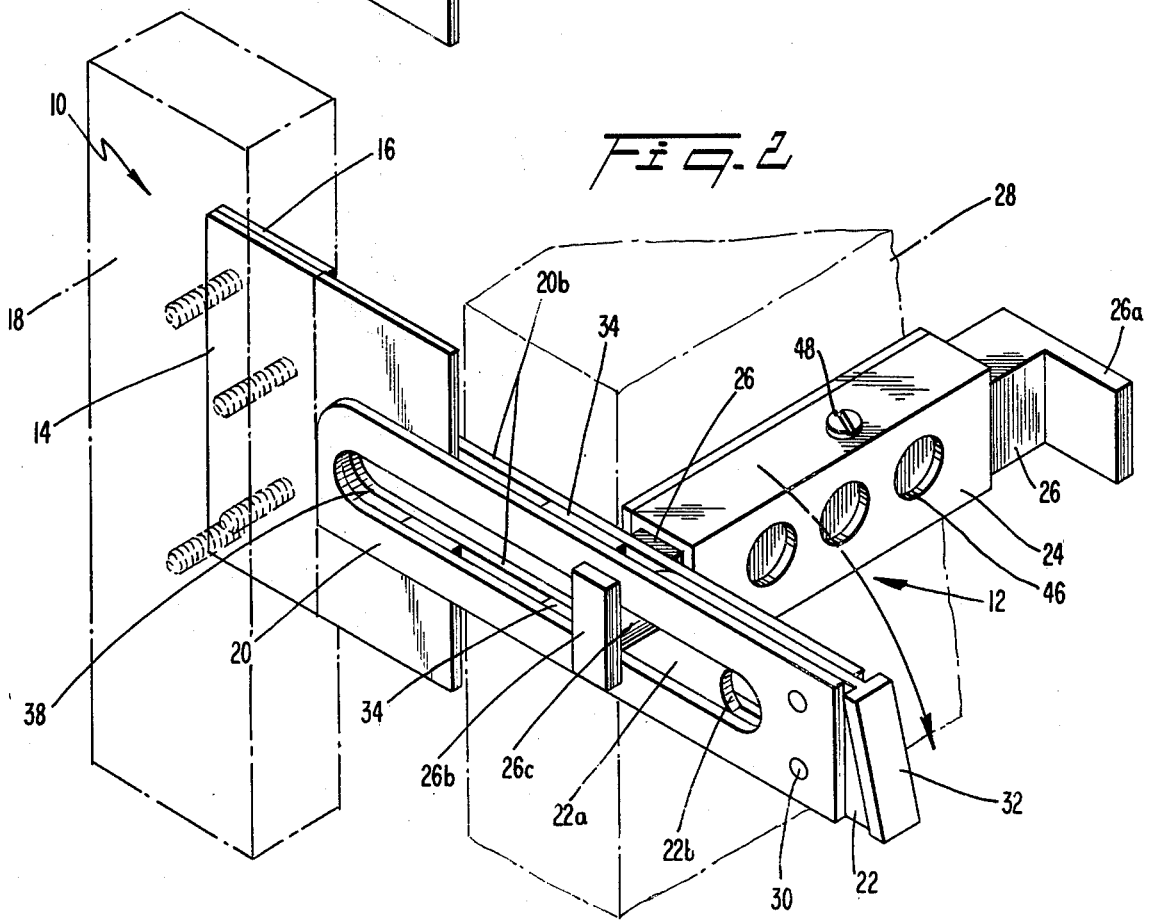
FIG. 2 is a perspective view of the lock mechanism of FIG. 1 showing the door in a first partially opened position.
Figure 3:
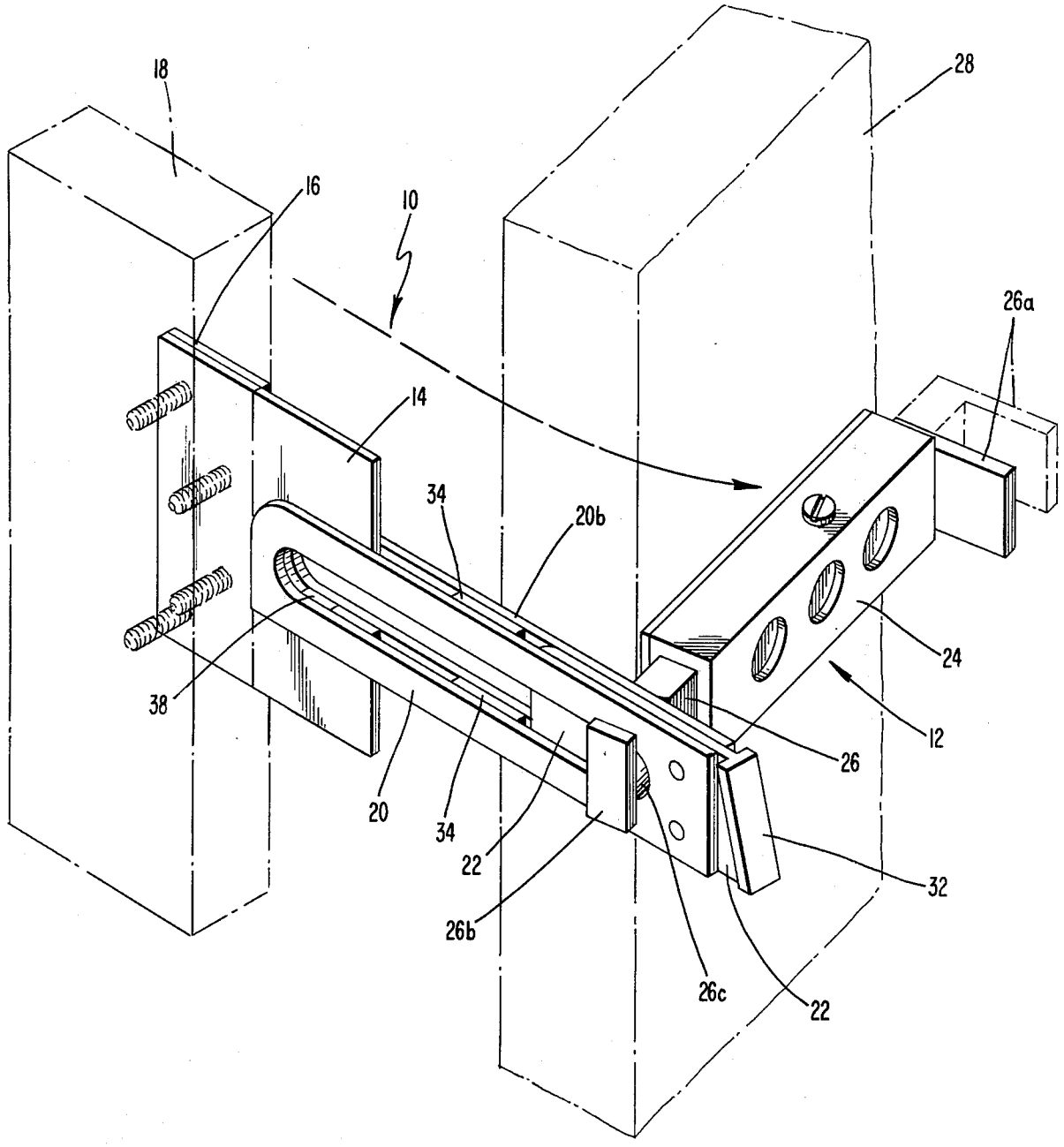
FIG. 3 is a perspective view of the lock mechanism of FIGS. 1 and 2 showing the door opened to its partially opened position.

The pivoting arm door safety locking mechanism according to the invention is shown in FIGS. 1–3 and comprises pivoting arm assembly 10 and sliding bolt assembly 12. Pivoting arm assembly 10 comprises pivot arm holding plate 14 having attached thereto pivot arm stop plate 16. Both the holding plate 14 and the stop plate 16 are attached to door jamb 18 such that holding plate 14 extends inwardly therefrom. Slotted arm 20 is pivotably attached to holding plate 14 by means to be hereinafter described. Pivot arm 20 is capable of moving from the vertical orientation shown in FIG. 1 to the generally horizontal orientation shown in FIGS. 2 and 3. Stop 22 is pivotably attached to the distal end of pivot arm 20 and is movable between a position where it extends across the slot in arm 20 to a second position where it does not extend across the slot.

Dead-bolt assembly 12 comprises sleeve 24 through which bolt 26 slidably extends. Bolt sleeve 24 is attached to door 28 by means to be hereinafter described. Dead-bolt 26 has inwardly extending handle **26*a* to enable the occupant to slide the bolt along its longitudinal axis into and out of engagement with pivoting arm assembly 10. The opposite end of bolt 26 terminates in "T" bolt head 26*b* which is connected to bolt 26 via "T" bolt neck 26*c* of reduced dimensions. The width of "T" bolt 26*b* is somewhat less than the width of the slot through arm 20 such that head 26*b* may be inserted into and retracted therefrom. As best shown in FIG. 1, when fully inserted bolt head 26*b* extends completely through pivot arm 20 and pivot holding plate 14**.

When the lock mechanism is in the position shown in FIG. 1, i.e. dead-bolt head **26*b* fully extended through pivot arm 20 and pivot arm 20 in its vertical orientation, the door is locked in its fully closed position. Since the longitudinal axis of dead-bolt 26 is coincident with the pivoting axis of arm 20, any force or blow to the door in an attempt to open it will not cause arm 20 to pivot to its lower position. Thus, no attempted entry can be made unless the occupant himself moves the pivot arm 20** to its horizontal position.

When it is desired to ascertain the identity of a caller, the occupant pivots the arm 20 to the position shown in FIG. 2 i.e. generally horizontal. The dimensions of "T" bolt neck **26*c* are smaller than the width of the slot in pivot arm 20 to thereby enable bolt 26 to physically move along the slot. However, since the vertical dimension of "T" bolt 26*b* is greater than the width of the slot, the bolt cannot be withdrawn from engagement with pivot arm 20 when the arm is in its horizontal position. Thus, the occupant can readily ascertain the caller's identity by opening the door until the bolt neck 26*c* engages edge 22*a* of pivoting stop 22**. This opens the door to its first partially opened position.

If the occupant desires to partially open the door a greater amount, so as to accept a small package, letter or the like, or if it is desired to lock the door in a partially opened position to facilitate ventilation, pivoting stop 22 is pivoted about pivot pin 30 by pushing on the lower edge of stop push plate 32. This raises the stop out of its position across the pivot arm slot and allows "T" bolt neck **26*c* to travel to the end of the slot. At this point, the occupant releases the force on push plate 32 to enable pivoting stop 22 to return to its initial position thereby engaging the bolt neck 26*c* between edge 22*b* and the end of the slot, as best seen in FIG. 3. Since the bolt neck 26*c* is positively engaged on both sides, it positively locks the door in a second, partially opened position. The slot in pivoting stop 22 through which bolt neck 26*c* travels may be slanted upwardly. The engagement of bolt neck 26*c* with the slanted slot forces the stop 22 to return to its initial position as the bolt neck 26*c* travels along the slot in pivoting arm 20**.

Figure 4:
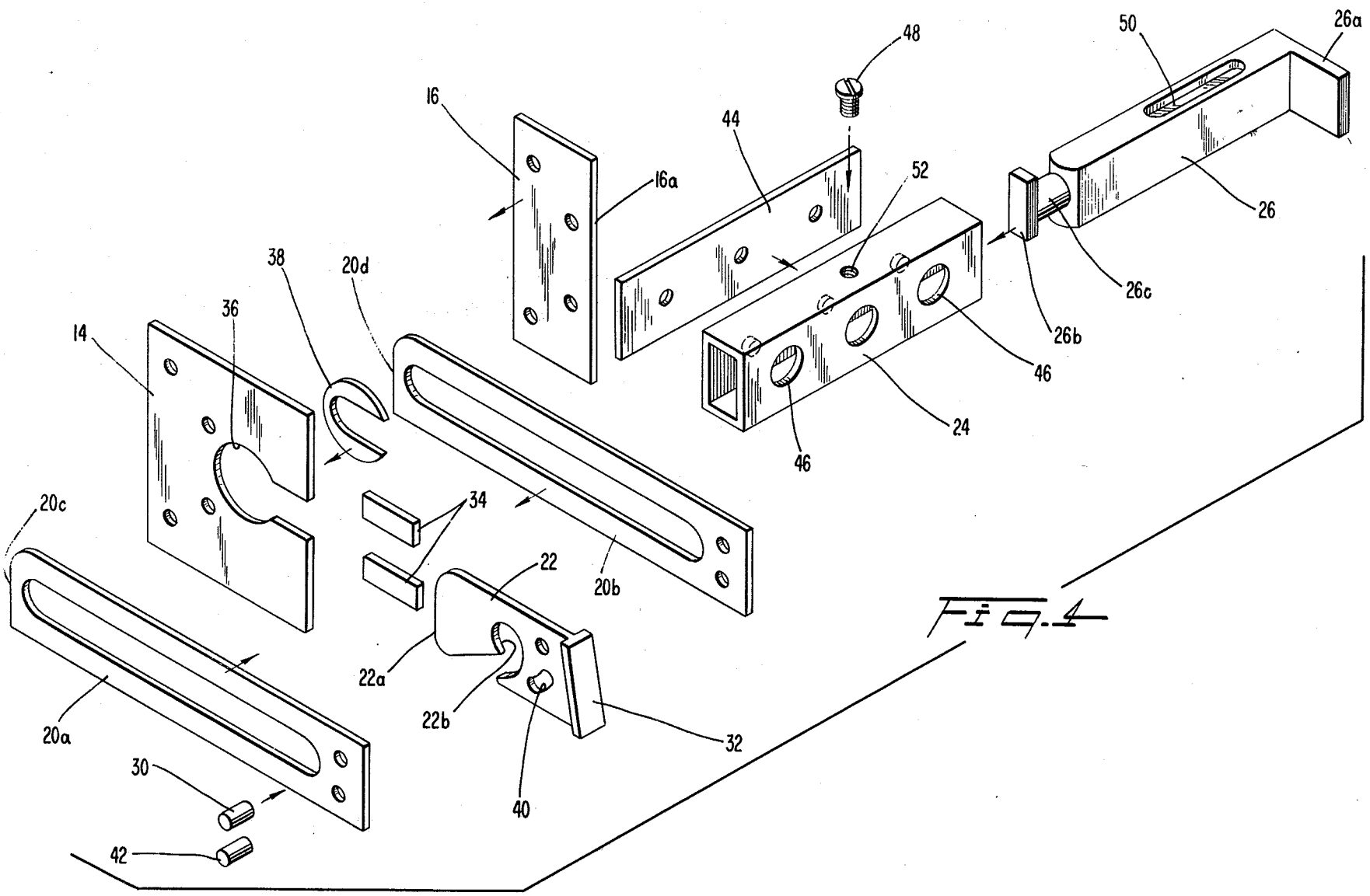
FIG. 4 is an exploded perspective view of a pivoting arm door safety lock mechanism according to the invention.

A typical construction of the pivot arm assembly and the "T" bolt assembly is shown in FIG. 4. Pivot arm holding plate 14 is attached to pivot stop plate 16 by screws, bolts or any other means. The pivot stop plate 16 is preferably separate from pivot arm holding plate 14 and may be placed on either side of the pivot arm holding plate, depending on whether the assembly is to be mounted on a left or right door jamb. The screws or bolts holding stop plate 16 and pivot arm holding plate together may also be used to attach the assembly to the door jamb. Pivot arm 20 comprises arm members **20*a* which are spaced apart from each other by pivot arm spacers 34. The width of pivot arm spacers 34 should be at least equal to and preferably slightly greater than the width of pivot arm holding plate 14 to allow the pivot arm members 20*a* and 20*b* to extend on either side of holding plate 14. Pivot arm holding plate 14 has a keyhole shaped opening 36 therein. Centerless pivot 38, having a slot extending partially therethrough equal in dimensions to the slot in arm members 20*a* and 20*b*, slidably engages the circular portion of keyhole shaped slot 36 and is attached to bolt arm members 20*a* and 20*b* by known means. Thus, arm members 20*a* and 20*b* along with centerless pivot 38 may pivot as a unit with respect to pivot arm holding plate 14. In the embodiment shown, both arm members 20*a* and 20*b* have rounded upper edge portions to allow the assembly to pivot upwardly. Edge portions 20*c* and 20*d* of arm members 20*a* and 20*b*, respectively, extend downwardly such that they engage edge 16*a* of pivot stop plate 16 and prevent the pivot arm 20** from pivoting downwardly past its generally horizontal position.

Pivoting stop 22 is pivotably attached to the opposite end of arm members **20*a* and 20*b* by inserting pivot pin 30 through both arm members and the pivoting stop 22. Pivoting stop 22 may have arcuate slot 40 therein which engages pin 42, also inserted through it and the two pivot arm members 20*a* and 20*b*, to limit its travel. Edge 22*a* should be generally vertical so as to prevent the contact between it and "T" bolt neck 26*c* from tending to pivot the pivoting stop 22 about its pivot pin 30**.

"T" bolt assembly 12 comprises bolt sleeve 24 which may be attached to the door via attaching plate 44. Sleeve 24 may have openings 46 therein so as to allow the passage therethrough of a screwdriver or other tool to place screws or the like, through the sleeve and attached plate 44 and into the door. "T" bolt 26 is slidably inserted through sleeve 24 and is prevented from sliding completely out of the sleeve by engagement of retainer screw 48 and elongated slot 50. Retainer screw 48 is screwed into threaded opening 52 through sleeve 24 such that its end slidably engages slot 50.

It is understood that the foregoing description of the preferred embodiment of the door safety lock mechanism is for illustrative purposes only and various modifications in construction may be undertaken without exceeding the scope of the appended claims.

I claim:

1. A door safety lock mechanism comprising:

(a) a slotted arm pivotally attached to a door jamb, said slotted arm comprising a pair of arm members affixed together, and said arm members having aligned slots therein;

(b) a slidable bolt attached to a door adjacent said slotted arm such that the longitudinal axis of the bolt is coincident with the pivoting axis of the slotted arm, the dimensions of a portion of the bolt being such as to pass through the slot when the arm is in a first position, and being prevented from passing through said slot when the arm is in a second position; and (c) means attached to said pivoting arm to engage said bolt and thereby lock the door in a partially open position, said means engaging said bolt being pivotally attached between said arm members.

2. The door safety lock mechanism of claim 1 wherein the slotted arm pivots in a generally vertical plane.

3. The door safety lock mechanism of claim 1 wherein said slotted arm travels through an arc of approximately 90 degrees from its first position wherein said arm is generally vertical, to its second position, wherein said arm is generally horizontal.

4. The door safety lock of claim 1, 2 or 3 wherein said slidable bolt has a "T" shaped head which engages said slotted arm.

5. The door safety lock of claim 1, 2 or 3 wherein said slotted arm comprises a pair of arm members affixed together, said arm members having aligned slots therein.

6. The door safety lock of claim 1, 2 or 3 wherein said slotted arm is pivotally attached to a pivot arm holding plate which, in turn, is attached to the door jamb.

7. A door safety lock mechanism comprising:

(a) an arm holding plate attached to a door jamb;

(b) a pair of arm members, each having a slot therethrough, affixed together such that said slots are in alignment with each other to form a slotted arm;

(c) pivoting means to pivotally attach said slotted arm to said arm holding plate such that said arm pivots, in a generally vertical plane, from a first position wherein it is generally vertical, to a second position wherein it is generally horizontal;

(d) a bolt sleeve attached to a door adjacent to said slotted arm holding plate;

(e) a slidable bolt, slidably retained in said bolt sleeve so as to move from a first position wherein it is disengaged from said slotted arms thereby allowing the door to be opened and closed in a normal manner, and a second position wherein a portion of said bolt passes through said slot in said slotted arm when said slotted arm is in its first position thereby locking said door in a closed position, and to permit a partial opening of said door when said slotted arm is in its second position, the vertical dimension of said portion of said slidable bolt that passes through said slot being greater than the width of said slot; and (f) a bolt stop pivotally attached to the distal end of said slotted arm between said arm members and being pivotable between a first position wherein it extends across the slot in said arm thereby limiting travel of said bolt along said slot, and a second position wherein it does not extend across said slot, thereby permitting unencumbered movement of said bolt along said slot.

* * * * *